United States Patent [19]

Grosshauser et al.

[11] Patent Number: 4,848,229

[45] Date of Patent: Jul. 18, 1989

[54] PRINTING PLATE FASTENING AND TENSIONING ASSEMBLY

[75] Inventors: Heinrich K. Grosshauser; Georg Schneider, both of Würzburg, Fed. Rep. of Germany

[73] Assignee: Koenig & Bauer Aktiengesellschaft, Würzburg, Fed. Rep. of Germany

[21] Appl. No.: 76,285

[22] Filed: Jul. 22, 1987

[30] Foreign Application Priority Data

Aug. 2, 1986 [DE] Fed. Rep. of Germany ..... 3626243

[51] Int. Cl.[4] ..... B41F 27/00

[52] U.S. Cl. ..... 101/382.1; 101/378; 101/415.1

[58] Field of Search ..... 101/382 MV, 415.1, 378

[56] References Cited

U.S. PATENT DOCUMENTS

| | | | |
|---|---|---|---|
| 2,730,949 | 1/1956 | Mitchell | 101/382 MV |
| 2,999,453 | 9/1961 | Roberts | 101/382 MV X |
| 3,730,092 | 5/1973 | Rickard et al. | 101/382 MV X |
| 3,745,626 | 7/1973 | Bray | 101/382 MV |
| 3,824,927 | 7/1974 | Pugh et al. | 101/382 MV X |
| 4,402,265 | 9/1983 | Pichard | 101/382 MV |
| 4,596,188 | 6/1986 | Benonie | 101/415.1 |
| 4,598,642 | 7/1986 | Taner et al. | 101/415.1 |
| 4,620,482 | 11/1986 | Fischer | 101/415.1 |
| 4,628,915 | 12/1986 | Van Kanegan | 101/415.1 |
| 4,646,639 | 7/1987 | Sollinger et al. | 101/415.1 |

FOREIGN PATENT DOCUMENTS

| | | | |
|---|---|---|---|
| 186648 | 11/1955 | Austria | 101/382 MV |
| 7218664 | 8/1970 | Fed. Rep. of Germany | 101/382 MV |
| 1936396 | 1/1971 | Fed. Rep. of Germany | 101/382 MV |
| 8413364 | 9/1984 | Fed. Rep. of Germany | 101/382 MV |

*Primary Examiner*—Edgar S. Burr
*Assistant Examiner*—James R. McDaniel
*Attorney, Agent, or Firm*—Jones, Tullar & Cooper

[57] ABSTRACT

A printing plate fastening and tensioning assembly for use with a plate cylinder of a rotary printing machine uses springs and magnets to provide holding forces. The springs bias fastening or tensioning bars away from walls of a groove formed in the peripheral surface of the plate cylinder. Magnetic forces provided by magnetic carried either by the plate cylinder or by these movable bars attract a portion of the bar to the groove wall. This alternative use of spring or magnetic forces effects either a fastening or tensioning of a selected end portion of a printing plate carried by the plate cylinder.

9 Claims, 5 Drawing Sheets

PRINTING PLATE FASTENING AND TENSIONING ASSEMBLY

FIELD OF THE INVENTION

The present invention is directed generally to a printing plate fastening and tensioning assembly. More particularly, the present invention is directed to a printing plate fastening and tensioning assembly for securing a flexible printing plate on a plate cylinder. Most specifically, the present invention is directed to a printing plate fastening and tensioning assembly for fastening and tensioning a printing plate by means of a movable tensioning element which is controlled by spring forces and also magnetic forces. This movable tensioning element is carried in a groove formed at the surface of the plate cylinder. Spring force applying devices and magnetic force applying devices are provided and cooperate with the movable tensioning element. These spring and magnetic forces work in concert to hold the printing plate tensioning element or elements in a plate tensioning or releasing position, or in a plate fastening position.

DESCRIPTION OF THE PRIOR ART

Various mechanisms and assemblies for fastening flexible printing plates to the outer periphery of rotatable plate cylinders in rotary printing machines are generally well known. Similarly, numerous assemblies are also generally known in the prior art for adjusting the tension applied to the printing plate once it has been fastened to the plate cylinder. German published unexamined patent application No. 19 36 396 shows a printing plate fastening and tensioning mechanism in which a carrier is secured in a rectangular groove formed in the outer circumference of a plate cylinder and parallel to its axis. This plate fastening and tensioning mechanism consists of two tensioning bars which are each pivotably supported at their lower end on an axis. At their upper ends, they each have a slit directed opposite to the tensioning direction and structured to accommodate the bent-over ends of the printing plate. Through the force of compression springs which are supported in boreholes in the walls of the carrier block, and which act horizontally on the outer walls of the tensioning bars, the tensioning bars are each pivoted around their respective turning axes away from the inner walls of the groove and towards each other. In order to tension and secure the tensioning bars, these bars are pivoted by cam discs which are secured to the tensioning bar turning axes, which act against the force of the compression springs, and which are stopped by means of bolts on the grooved base.

A different prior art printing plate tensioning mechanism is shown in the German utility model No. 72 18 664. In this device, a plate tensioning mechanism is arranged in a trapezoidal groove. This plate tensioning mechanism consists of two bars which are each pivotably supported at their lower ends on the groove base. On their upper ends, they have hooks pointed in the tensioning direction which are hooked into prepunched leading and end edges of a printing plate. Plate tensioning for one of the bars is applied by a leaf spring which is aligned such that It biases the bar toward the middle of the slot. The other bar is tensioned through the force of a spiral spring. This spring supports itself horizontally on a carrier block in the middle of the slot and pivots its associated tensioning bar in the direction of an inner wall of the groove. An adjustment of the bars against the forces of the respective springs is achieved by turning a cam shaft with a tool. The cam shaft which acts against the force of the spiral spring is arranged parallel to the slot in a side wall of the plate cylinder, the other cam shaft which acts against the force of the leaf spring is attached to the carrier block in the middle of the groove.

A prior art tensioning mechanism with a single tensioning shaft is shown in German utility model 84 13 364. This tensioning shaft is arranged in a generally known manner in a groove on the circumference of the plate cylinder and parallel to the axis of the cylinder. To produce a tensioning force, a torsion bar spring is provided so that a deflection of the torsion shaft in either a clockwise of counterclockwise direction is always achieved against the force of the torsion bar spring. This torsion shaft has two slits above its turning axis which are in opposite directions to each other and in which, if desired, a bent-over beginning or end of printing plate can be hooked. The groove has two hooking-in edges at its opening part which are secured to the plate cylinder to accommodate the printing plate beginning or end. For tensioning, the printing plate is hooked at its leading end into the hooking-in edge and pointing in a plate cylinder rotational direction. Then the tensioning shaft is pivoted with a tool in the direction of rotation of the plate cylinder and the end of the printing plate is hooked into the accessible slit in the tensioning shaft. When the tensioning shaft is released, it pivots, because of the force of the torsion bar spring, back into its starting position and tensions the printing plate.

The various prior art printing plate fastening and tensioning assemblies, such as those discussed above, have various features that have made them expensive, difficult to operate, and requiring specialized tools. Some of the generally known printing plate fastening and tensioning devices have required the user to purchase specialized tools or have been apt to not secure the printing plate in a dependable manner. Certain other of the prior art devices have made no provision for holding the printing plate holding bar or the like in its released or plate out of tension position. This means that the press operator can use only one hand to place the end of the printing plate in its slot or opening since the operator must use his other hand to hold the clamping means in its open, or out of tension position.

While the prior art has proposed numerous printing plate fastening and tensioning assemblies, these devices have failed to provide a completely satisfactory device. Thus the need exists for a printing plate fastening and tensioning assembly which is efficient in operation, which is not expensive and does not require specialized or expensive tools, and which can be operated by hand and which will allow the press operator to have both hands free for plate insertion. The printing plate fastening and tensioning assembly of the present invention provides such a device.

SUMMARY OF THE INVENTION

It is an object of the present invention to provide a printing plate fastening and tensioning assembly.

Another object of the present invention is to provide a printing plate fastening and tensioning assembly for a plate cylinder of a rotary printing machine.

A further object of the present invention is to provide a printing plate fastening and tensioning assembly utilizing spring and magnetic forces.

Yet another object of the present invention is to provide a printing plate fastening and tensioning assembly in which magnets are used to hold the tensioning element in a desired position.

Still a further object of the present invention is to provide a printing plate fastening and tensioning assembly which requires no specialized tools Even yet another object of the present invention is to provide a printing plate fastening and tensioning assembly that can be moved by hand between its desired positions.

As will be discussed in greater detail in the description of the preferred embodiment, as set forth subsequently, the printing plate fastening and tensioning assemblies in accordance with the present invention utilize both spring and magnetic forces to tension ends of a printing plate and to fasten the plate onto the periphery of the printing plate cylinder. In each of the three disclosed preferred embodiments, the width of the groove formed in the plate cylinder may be kept relatively narrow. This keeps the print free area of the plate to a minimum so that more printing can be done by each plate cylinder. In two of the preferred embodiments, the clamping and tensioning assembly can be operated manually while in the third embodiment only a simple tool is required.

The printing plate fastening and tensioning assembly in accordance with the present invention applies all the forces required to maintain proper plate tensioning in the area between the tensioning bar or bars and the inner walls of the slot in which the bars are located. This means that a supporting device positioned between the tensioning bars and in the middle of the groove is not necessary. Thus, as was discussed above, the width of the groove can be kept quite narrow so that the print free space is kept quite small. In the third preferred embodiment only a single tensioning bar is used to that the groove can be kept even smaller.

The printing plate fastening and tensioning assembly in accordance with the present invention is a significant improvement over the prior art devices. The assembly of the present invention does not require expensive or difficult to use tools and in two of the preferred embodiments, can be operated by hand. The combination of the spring forces and magnetic forces working in a cooperative manner allows the tensioning bar or bars to be placed in any desired position and to maintain that position. Further, in the first two preferred embodiments, which use two tensioning bars, each of the bars can be used as a clamping device or as a tensioning device so that the printing plate cylinder can be rotated in either direction. Thus the printing plate fastening and tensioning assembly in accordance with the present invention provides better plate fastening and tensioning in a less complex, more durable device.

BRIEF DESCRIPTION OF THE DRAWINGS

While the novel features of the printing plate fastening and tensioning assembly in accordance with the present invention are set forth with particularity in the appended claims, a full and complete understanding of the invention may be had by referring to the detailed description of the preferred embodiments, as are set forth subsequently, and as may be seen in the accompanying drawings in which:

DESCRIPTION OF THE PREFERRED EMBODIMENTS

Figure 1:
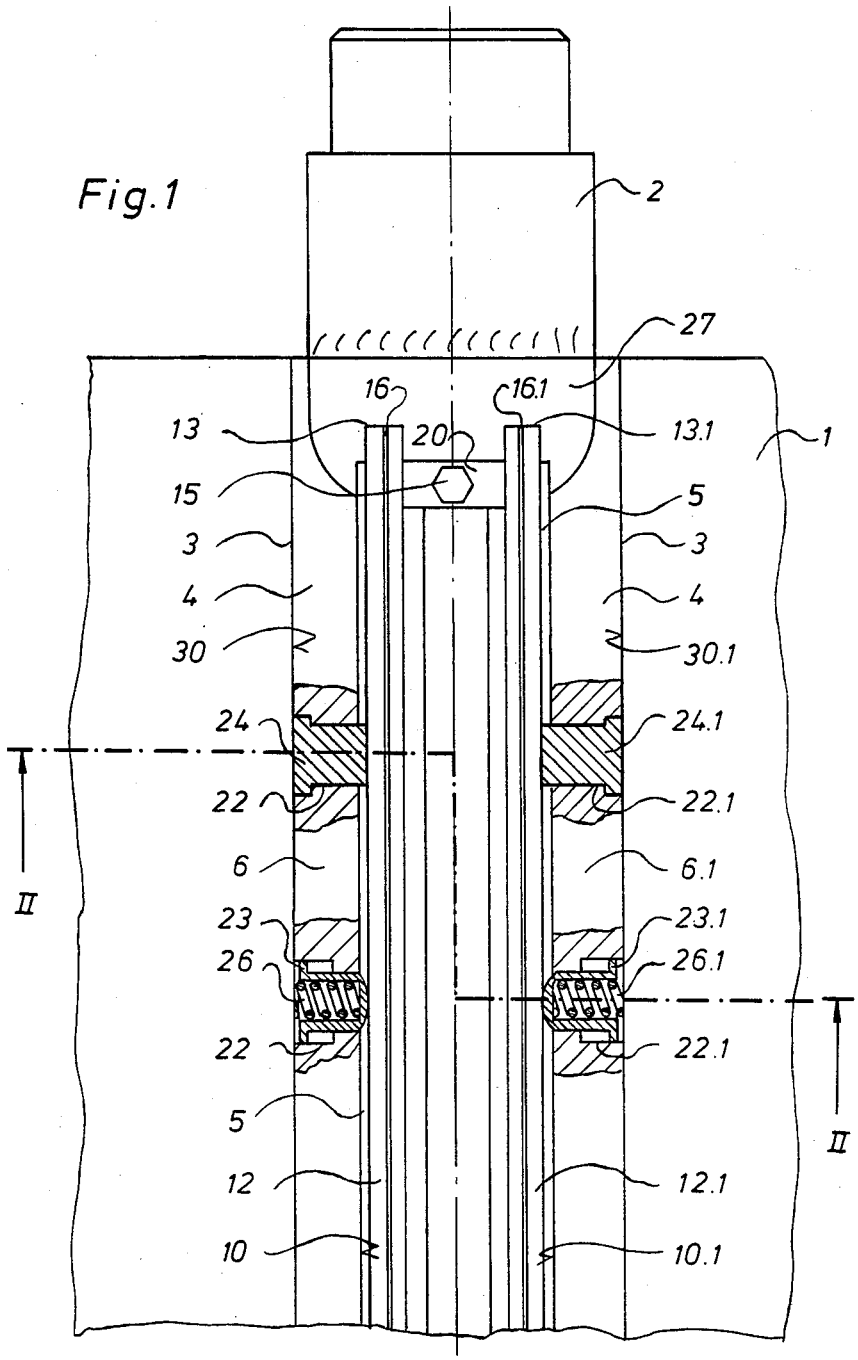
FIG. 1 is a top plan view of a first preferred embodiment of a printing plate fastening and tensioning assembly in accordance with the present invention.
Figure 2:
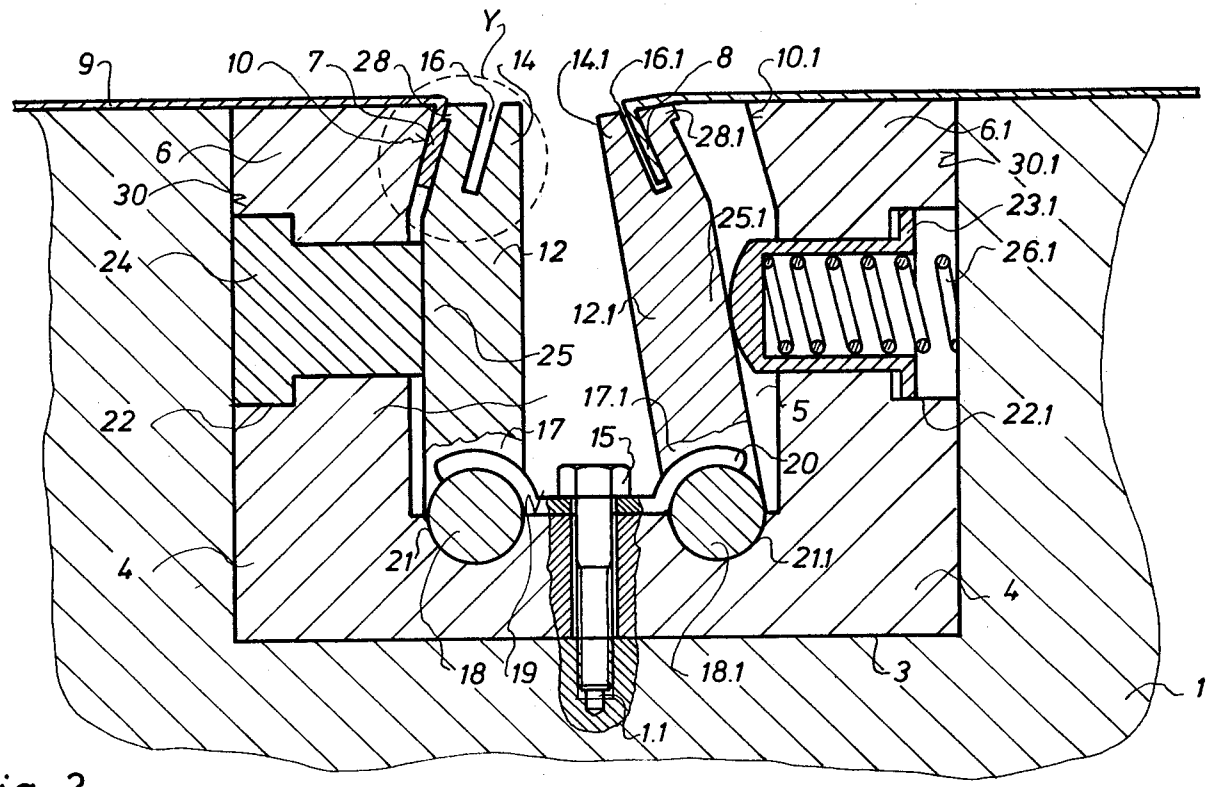
FIG. 2 is a cross-sectional view of the plate fastening and tensioning assembly of FIG. 1 and taken along line II—II.

Referring initially to FIGS. 1 and 2, there may be seen at first preferred embodiment of the printing plate fastening and tensioning assembly in accordance with the present invention. A plate cylinder 1 is rotatably supported by its two stump shafts 2 in frames of a rotary printing machine (not shown). A rectangular shaped slot 3 is formed on the circumference of the plate cylinder 1 and is parallel to the axis of plate cylinder 1. Slot 3 accommodates a carrier block 4 which has a groove 5 parallel to its axis and which in its upper part; i.e., in the area of its opening, has two hooking edges 10; 10.1. A hook-shaped, bent-over front or rear edge, 7 or 8 respectively, of a printing plate 9 can be put in to these hooking-in edges 10; 10.1. In groove 5, two bars 12 and 12.1 are arranged. Each of these bars 12 and 12.1 has a head portion 14 and 14.1, respectively, and each such head portion is provided with an elongated slit or slot 16 or 16.1, respectively. These slots 16, 16.1 extend the lengths of bars 12, 12.1 and each can receive either the front edge 7 on the rear edge portion 8 of printing plate 9.

Each foot part 17 or 17.1 of bars 12; 12.1 has a round steel rod 18; 18.1 welded thereto and with which they are are freely pivotably supported on a groove base portion 19 of the carrier block 4 in a semicircular slot 21 or 21.1. In this semi-circular slot 21, 21.1 the bars 12, 12.1 are held by means of two clips 20. These clips are fastened with hexagonal screws in to the groove base 19. These screws 15 project through the clips 20 and the carrier block 4 and extend out into threaded holes 1.1 in the plate cylinder body 1.

Several horizontal tappets 23, 28.1 and several horizontal magnets 24, 24.1 are alternately carried in spaced boreholes 22, 22.1 in both side walls 6, 6.1 of carrier block 4. As may be seen in FIG. 1, these tappets 28 and 23.1 and magnets 24 and 24.1 are spaced opposite to each other in side walls 6 and 6.1 of carrier block 4. The tappets 23, 23.1 are pushed to the center of groove 5 by the force of compression springs 26, 26.1. These compression springs 26, 26.1 are supported against the slot insides 30, 30.1 and shift their respective tappets 28, 23.1 horizontallY in the direction of the middle of the groove. There they rest against the middle parts 25, 25. of the tensioning bars 12, 12.1 and press these in the direction of the groove middle.

Figure 4:
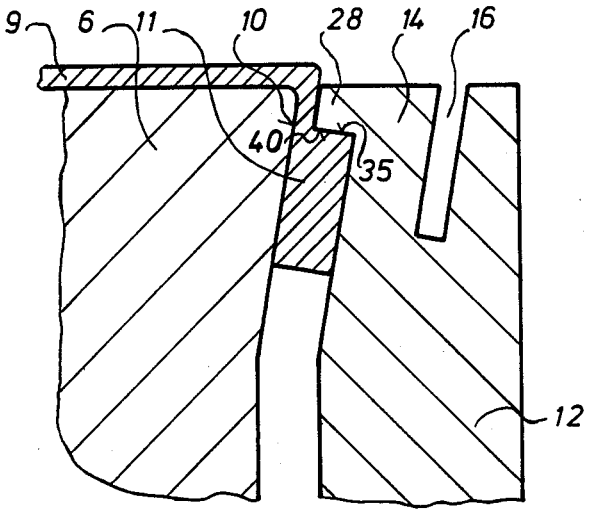
FIG. 4 is an enlarged detail view of a portion of the first preferred embodiment show in FIG. 2 and taken in the encircled area Y of FIG. 2.

A head portion 14, 14.1 of e ach of the tensioning bars 12, 12.1 has a low register protrusion 28, 28.1 directed toward the side wall 6, 6.1 of groove 5 for clamping a front edge 7 or rear edge 8 of the printing plate 9, as may be seen in FIG. 4. The register protrusions 28, 28.1 represent, particularly when using photopolymer printing plates which have a plate thickness of approximately 1 mm, a vertical register stop for the front edge 7 of the printing plate 9 which is structured as a sharp edged or straight-edged rim 11 with a thickness of approximately 5 mm which determines the circumferential register. Naturally, conventional printing plates of metal can also be clamped and tensioned with the clamping and tensioning mechanism in accordance with the invention.

To open the printing plate clamping and tensioning mechanism shown in FIGS. 1 and 2, the bar is pressed, without the use of tools, such as with the thumb, at one end 13, 13.1 in a direction of the force of the compression springs 26 and against the attraction force of the magnets 24 and is moved away from the side wall 6. In doing so, the bar 12 arrives at a position in which the pressure force of the springs 26 is larger than the attraction force of the magnets 24 and the bar 12 is moved into the "open" position, as shown in the right side of FIG. 2, and stops there.

The bent-over or rolled up front edge 7 of the printing plate 9 may now be put in the gap generated between bar 12 and side wall 6 after tensioning bar 12 has been pushed away from side wall 6 and the spring forces of springs 26 have overcome the magnetic forces of magnets 24. This printing plate front edge 7 will be held by hooked edge 10 of groove 5

When the bar 12 is pivoted back against the force direction of the compression springs 26 and in the direction of the attraction force of the magnets 24, the attraction force of the magnets 24 eventually outweighs the spring force and the front edge 7 of the printing plate 9 is clamped between register protrusion 28 and side wall 6. The bar 12 is held in this "clamping" position, since the force of the magnets 24 for a small gap such as the thickness of the printing plate is larger than the force of the compression springs 26. If photopolymer plates are used, then the rim 11 of the plate rests with its outer edge 36 locked against the lower edge 40 of the register protrusion 28, as may be seen most clearly in FIG. 4.

To tension, in this example the printing plate 9, its rear edge 8 is put into the slit 16.1 of the head part 14.1 of the second bar 12.1 which is positioned in a "putting in" position. Since the holding force of the magnets 24.1 in this position is greater than the counterpressure of the compressions springs 26.1, the bar 12.1 with "put-in" plate end 8 inserted, is then pivoted with the thumb in the direction of the force of the compression springs 26.1 and against the direction of the attraction force of the magnets 24.1. The bar 12.1 with the printing plate rear end 8 will eventually move to a "tensioning" position in which the spring force of the compression springs 26.1 outweighs the magnetic force. This is because the gap created between the magnets 24.1 and the tensioning bar 12.1 is too large and thus the counter-exerted holding force of the magnets 24.1 has become negligibly small. As was indicated above, the thumbs of the press operator can be used to more the gripping bars 12 and 12.1. As may be seen in FIG. 1, this is facilitated by the provision of grip cavities 27 on each of the two ends of the carrier block 4 into which the ends 13, 13.1 of each of the bars 12, 12.1 protrude. These cavities are sized and shaped to accommodate a thumb of the operator so that the gripping bars can be moved manually without the need for expensive, complex tools.

Figure 3:
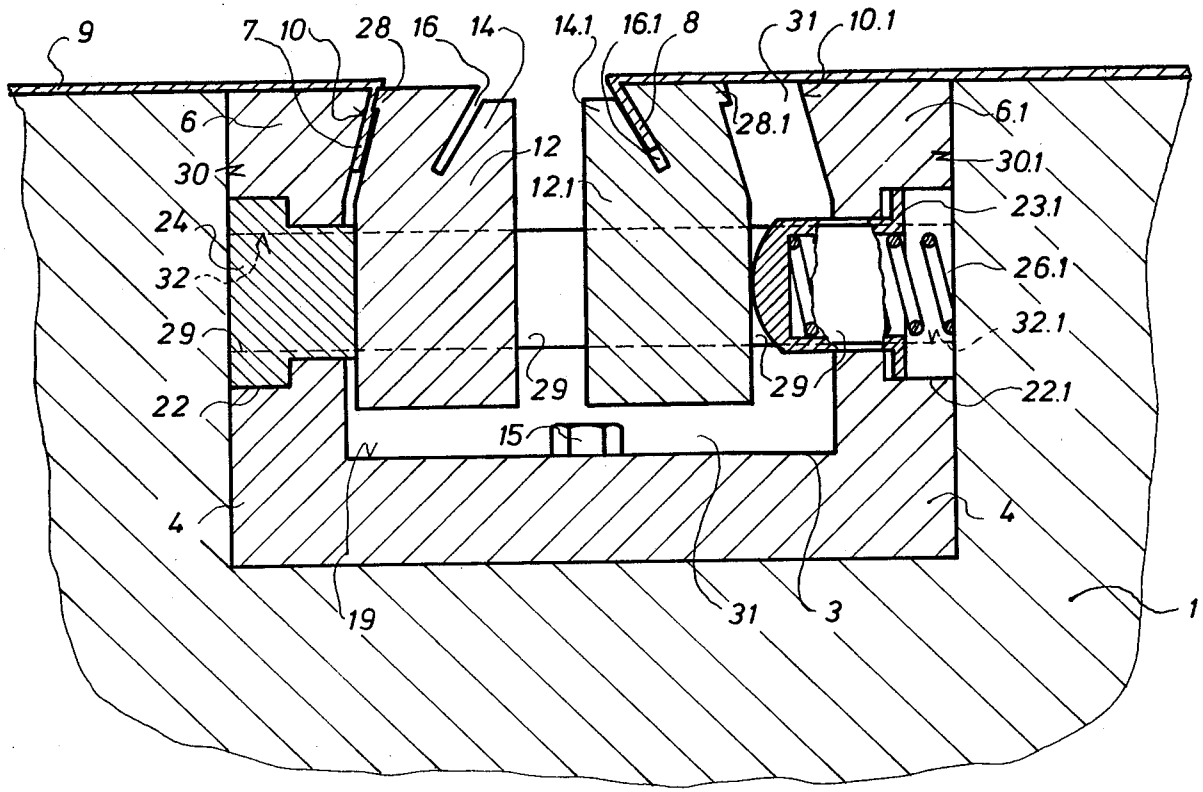
FIG. 3 is a cross-sectional view of a second preferred embodiment of the printing plate fastening and tensioning assembly of the present invention.

A second preferred embodiment of the printing plate fastening and tensioning assembly in accordance with the present invention is shown in FIG. 3. In this second preferred embodiment, the arrangement of the magnets 24, 24.1 and springs 26, 26.1 is the same as that disclosed in the first embodiment. Differences between these two embodiments lie in the type of bearings and direction of movement of the bars 12, 12.1 which, for reasons of stability, are thicker, and thus the resulting width of the channel 31 which, being as wide as the channel 5 in the first embodiment, is less deep. The bars 12, 12.1 are commonly supported on several cylinder-shaped rails 29 so as to be horizontally movable independent of one another. These rails 29 are arranged perpendicular to the axis-parallel course of the cylinder groove 5 in bore-holes 32, 32.1. The bore-holes 32, 32.1 are situated in the side walls 6, 6.1 of the carrier block 4, and are parallel to the compression springs 26, 26.1 and magnets 24, 24.1. It is also possible with both embodiments to also integrate the tensioning and holding elements which apply the force, such as magnets 24, 24.1 and springs 26, 26.1, into the tensioning bars 12, 12.1.

Figure 5:
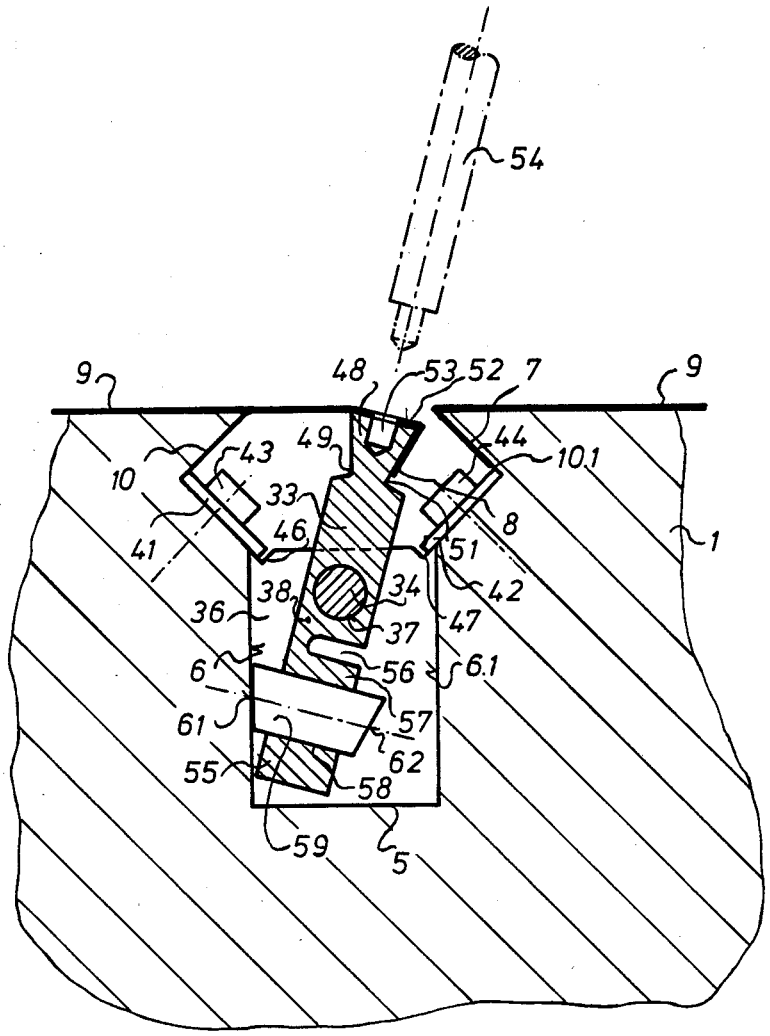
FIG. 5 is a cross-sectional view of a third preferred embodiment of the printing plate fastening and tensioning assembly of the present invention.

A third preferred embodiment of the printing plate fastening and tensioning assembly of the present invention is shown in FIG. 5. In this embodiment, the groove 5 which accommodates the tensioning assembly, is machined directly into the plate cylinder 1. The cylinder groove 5 is rectangular in cross-section and has, in its opening part, two hooking edges 10, 10.1 into which the bent-over front or rear edge 7, 8 of the printing plate 9 can be placed. In the middle of the cylinder groove 5 an elongated narrow tensioning bar 33, which may be about 6 mm thick, is pivotably supported at its opposite ends in two bearing brackets 36 by two cylinder bolts 34. The two cylinder bolts 34 each extend into a horizontal borehole 37 in each of the end surfaces 38 of the tensioning bar 33. The bearing brackets 36 are arranged at the ends of the cylinder groove 5, and are prevented from slipping out of the groove 5 by two discs 41, 42 each of which is secured, in the area of hooking edges 10, 10.1 on the plate cylinder body 1, by fastening screws 48, 44. The discs 41, 42 protrude somewhat into the cylinder groove 5 and each grips into a triangular slot 46, 47 in the upper side of the bearing brackets 36.

The tensioning bar 33 has in its upper portion two triangular recesses 49, 51 which are symmetrical with each side, and into which the bent-over rear edge 8 of the printing plate 9 is put. In the upper face 52 of the tensioning bar 33 a bore-hole is provided which serves to accommodate a lever bolt 54 that is insertable into the borehole 53 through a hole in the printing plate end. Below the cylinder bolts 84, a longitudinal slot 56 is machined into the tensioning bar 33. This slot 56 extends along the whole length of the tensioning bar 33 and reduces the spring rigidity of lower part 57 of bar 33. In a foot section 55 of the tensioning bar 33, several transverse boreholes 68 are provided, at distances distributed over the length of the tensioning bar 33, and in which bar magnets 59 are secured. These bar magnets 59 protrude, with both their poles 61, 62 beyond the width of the tensioning bar 33. The ends of the bar magnets 59 are ground off in the area of their poles 61, 62 so as to be slightly angular so that in cross-section trapezoid form results, in which the longest side is arranged on top. The angle of inclination of the poles 61, 62 is determined by the pivot angle of the tensioning bar 33 so that in a pivoted out position, the poles 61, 62 of the bar magnets 59 abut flatly against a ferromagnetic cylinder groove side wall 6, 6.1.

To fasten the printing plate 9 to the plate cylinder 1, the bent-over front edge 7 of the printing plate 9 is put into the appropriate hooking edge 10 or 10.1. The tensioning bar 33 is pivoted in the rotational direction of the plate cylinder 1 by means of a lever bolt 54. For this, one end of the lever bolt 54 is inserted into the borehole 53 of the tensioning bar 33 and pivoted in the rotation direction by hand until the poles 62 of the bar magnets 59 rest against the cylinder groove wall 6.1. In this position the magnets 59 then hold the tensioning bar 33. Now the rear edge 8 of the printing plate 9 can be put into recess 51 of the tensioning bar 33, with this recess being directed opposite to the rotation direction of the plate cylinder 1. A tensioning of the printing plate 9 may now be achieved by pivoting the tensioning bar 33 opposite to the rotational direction of the plate cylinder 1 until the opposite poles 61 of the bar magnets 59 rest against the ferromagnetic side wall 6 of the cylinder groov 5 where it is held by magnetic force. In doing this, a spring effect of the tensioning bar 83 is applied through an elastic deflection of the lower part 57 which has been weakened by the longitudinal slot 56. The tensioning bar 33 is now in a "tensioning" position. The printing plate 9 is held independently on the periphery of the plate cylinder 1 without the need for further clamping devices due to the angles of the inclines on the hooking edges 10, 10.1 and of the recesses 49, 49.1.

While three preferred embodiments of a printing plate fastening and tensioning assembly in accordance with the present invention have been fully and completely set forth hereinabove, it will be apparent to one of skill in the art that a number of changes in, for example the type of printing plate being used, the size of the plate cylinder, the materials used for the plate cylinder generally, the types of springs and the like could be made. Further, it will be understood that while permanent magnets have been disclosed as providing the holding forces, these could be replaced by electromagnets. Additionally, while the materials used to make the plate cylinder could vary, the parts such as the side walls and tensioning bars which contact the poles of the magnets must be manufactured from, or coated with, a ferromagnetic material. These, and other various changes could be made without departing from the true spirit and scope of the invention which is accordingly to be limited only by the following claims.

What is claimed is:

1. A printing plate fastening and tensioning assembly usable to fasten and tension a flexible printing plate on a plate cylinder of a rotary printing machine, said fastening and tensioning assembly comprising:

at least a first movable plate fastening and tensioning element positioned for movement in an axial groove extending along a surface portion of the plate cylinder, said plate fastening and tensioning element being movable in said groove between printing plate fastening and tensioning positions in which positions the spacing of an outer portion of said plate fastening and tensioning element with respect to a first edge of said groove is varied;

means on said outer portion of said plate fastening and tensioning element for selectively fastening and tensioning a first end of the printing plate;

at least a first spring means for applying a spring force to said plate fastening and tensioning element to urge said outer portion of said plate fastening and tensioning element toward said plate tensioning position, said spring force tending to exert a plate tensioning force on said end of said printing plate;

means to secure a second end of said printing plate to a second edge of said axial groove; and at least a first magnet means for applying a magnetic force to said plate fastening and tensioning element in opposition to said spring force to counteract said tensioning force on said printing plate, said magnet means urging said outer portion of said plate fastening and tensioning element toward said plate fastening position in said axial groove and tending to exert a plate fastening force on said end of said printing plate wherein said spring force overcomes said magnetic force when said movable plate fastening and tensioning element is in said plate tensioning position and further wherein said magnetic force overcomes said spring force when said moveable plate fastening and tensioning element is in said plate fastening position.

2. The printing plate fastening and tensioning assembly of claim 1 wherein said movable plate fastening and tensioning element is a tensioning bar.

3. The printing plate fastening and tensioning assembly of claim 1 wherein said magnet means is a bar shaped permanent magnet.

4. The printing plate fastening and tensioning assembly of claim 1 wherein said magnet means includes a plurality of bar magnets in said movable plate fastening and tensioning element.

5. The printing plate fastening and tensioning assembly of claim 1 wherein said magnet means includes a plurality of bar magnets positioned in side walls of said axial groove.

6. The printing plate fastening and tensioning assembly of claim 2 wherein said tensioning bar is pivotably carried in said axial groove.

7. The printing plate fastening and tensioning assembly of claim 2 wherein said tensioning bar is horizontally shiftable.

8. The printing plate fastening and tensioning assembly of claim 2 wherein said tensioning bar has register protrusion on its upper surface.

9. The printing plate fastening and tensioning assembly of claim 1 wherein said spring means includes a longitudinal slot in said movable plate fastening and tensioning element.

* * * * *